US009488012B2

(12) United States Patent
Thigpen

(10) Patent No.: US 9,488,012 B2
(45) Date of Patent: Nov. 8, 2016

(54) STREAMLINED POCKET DESIGN FOR PDC DRILL BITS

(71) Applicant: Varel International Ind., L.P., Carrollton, TX (US)

(72) Inventor: Gary M. Thigpen, Houston, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 305 days.

(21) Appl. No.: 14/103,184

(22) Filed: Dec. 11, 2013

(65) Prior Publication Data

US 2014/0182949 A1 Jul. 3, 2014

Related U.S. Application Data

(60) Provisional application No. 61/747,045, filed on Dec. 28, 2012.

(51) Int. Cl.

| | |
|---|---|
| ***E21B 10/54*** | (2006.01) |
| ***E21B 10/633*** | (2006.01) |
| ***E21B 10/62*** | (2006.01) |

(52) U.S. Cl.

CPC ..... *E21B 10/633* (2013.01); *E21B 10/54* (2013.01); *E21B 10/62* (2013.01); *Y10T 29/49826* (2015.01)

(58) Field of Classification Search

CPC ..... E21B 10/54; E21B 10/62; E21B 10/633

See application file for complete search history.

(56) References Cited

U.S. PATENT DOCUMENTS

| | | | | |
|---|---|---|---|---|
| 5,333,699 | A | 8/1994 | Thigpen et al. | |
| 7,594,554 | B2 | 9/2009 | Schwefe et al. | |
| 7,909,121 | B2 | 3/2011 | Voronin et al. | |
| 2007/0278017 | A1 | 12/2007 | Shen et al. | |
| 2008/0073125 | A1 | 3/2008 | Eason et al. | |
| 2008/0083568 | A1 | 4/2008 | Overstreet et al. | |
| 2010/0263937 | A1* | 10/2010 | Overstreet | E21B 10/43 175/426 |
| 2010/0276210 | A1 | 11/2010 | Prajapati et al. | |

OTHER PUBLICATIONS

Copenheaver, Blaine R, Written Opinion of the International Searching Authority for PCT/US2013/074392, Apr. 2, 2014, pp. 1-16.

Notification of First Office Action dated Jun. 29, 2016 for app. # 201380068343.5.

Extended European Search Report dated Aug. 8, 2016 for app. # 13868072.3.

* cited by examiner

*Primary Examiner* — Brad Harcourt

(57) ABSTRACT

A cutter pocket, a downhole tool formed with at least one cutter pocket, and a method for coupling a cutter to the cutter pocket is described herein. The cutter pocket is formed within at least one blade of the downhole tool and includes a pocket back fabricated from a first material, a first pocket side extending from one end of the pocket back to a leading edge of the downhole tool, and a second pocket side extending from an opposing end of the pocket back to the leading edge. The pocket back and the pocket sides define a cavity. A cutter is positioned and coupled at least partially within the cavity. The height of an upper surface of the first material of the pocket back ranges between thirty percent to sixty-five percent of the cutter girth.

19 Claims, 4 Drawing Sheets

STREAMLINED POCKET DESIGN FOR PDC DRILL BITS

RELATED APPLICATIONS

The present application is a non-provisional application of and claims priority under 35 U.S.C. §119 to U.S. Provisional Application No. 61/747,045, entitled "Streamlined Pocket Design For PDC Drill Bits" and filed on Dec. 28, 2012, the entirety of which is incorporated by reference herein.

TECHNICAL FIELD

The present invention relates generally to downhole tools used in subterranean drilling, and more particularly, to cutter pockets formed within downhole tools and methods for fabricating the cutter pockets and mounting a cutter therein.

BACKGROUND OF THE INVENTION

Drill bits are commonly used for drilling bore holes or wells in earth formations. One type of drill bit is a fixed cutter drill bit which typically includes a plurality of cutting elements, or cutters, disposed within a respective cutter pocket formed within one or more blades of the drill bit.

FIG. 1 shows a perspective view of a drill bit 100, or fixed cutter drill bit 100, in accordance with the prior art. Referring to FIG. 1, the drill bit 100 includes a bit body 110 that is coupled to a shank 115 and is designed to rotate in a counter-clockwise direction 190. The shank 115 includes a threaded connection 116 at one end 120. The threaded connection 116 couples to a drill string (not shown) or some other equipment that is coupled to the drill string. The threaded connection 116 is shown to be positioned on the exterior surface of the one end 120. This positioning assumes that the drill bit 100 is coupled to a corresponding threaded connection located on the interior surface of a drill string (not shown). However, the threaded connection 116 at the one end 120 is alternatively positioned on the interior surface of the one end 120 if the corresponding threaded connection of the drill string, or other equipment, is positioned on its exterior surface in other exemplary embodiments. A bore (not shown) is formed longitudinally through the shank 115 and extends into the bit body 110 for communicating drilling fluid during drilling operations from within the drill string to a drill bit face 111 via one or more nozzles 114 formed within the bit body 110.

The bit body 110 includes a plurality of gauge sections 150 and a plurality of blades 130 extending from the drill bit face 111 of the bit body 110 towards the threaded connection 116, where each blade 130 extends to and terminates at a respective gauge section 150. The blade 130 and the respective gauge section 150 are formed as a single component, but are formed separately in certain drill bits 100. The drill bit face 111 is positioned at one end of the bit body 110 furthest away from the shank 115. The plurality of blades 130 form the cutting surface of the drill bit 100. One or more of these plurality of blades 130 are either coupled to the bit body 110 or are integrally formed with the bit body 110. The gauge sections 150 are positioned at an end of the bit body 110 adjacent the shank 115. The gauge section 150 includes one or more gauge cutters (not shown) in certain drill bits 100. The gauge sections 150 typically define and hold the full hole diameter of the drilled hole. Each of the blades 130 and gauge sections 150 include a leading edge section 152, a face section 154, and a trailing edge section 156. The face section 154 extends from one end of the trailing edge section 156 to an end of the leading edge section 152. The leading edge section 152 faces in the direction of rotation 190. The blades 130 and/or the gauge sections 150 are oriented in a spiral configuration according to some of the prior art. However, in other drill bits, the blades 130 and/or the gauge sections 150 are oriented in a non-spiral configuration. A junk slot 122 is formed, or milled, between each consecutive blade 130, which allows for cuttings and drilling fluid to return to the surface of the wellbore (not shown) once the drilling fluid is discharged from the nozzles 114 during drilling operations.

A plurality of cutters 140 are coupled to each of the blades 130 within a respective cutter pocket 160 formed therein. The cutters 140 are generally formed in an elongated cylindrical shape; however, these cutters 140 can be formed in other shapes, such as disc-shaped or conical-shaped. The cutters 140 typically include a substrate 142, oftentimes cylindrically shaped, and a cutting surface 144, also cylindrically shaped, disposed at one end of the substrate 142 and oriented to extend outwardly from the blade 130 when coupled within the respective cutter pocket 160. The cutting surface 144 can be formed from a hard material, such as bound particles of polycrystalline diamond forming a diamond table, and be disposed on or coupled to a substantially circular profiled end surface of the substrate 142 of each cutter 140. Typically, the polycrystalline diamond cutters ("PDC") are fabricated separately from the bit body 110 and are secured within a respective cutter pocket 160 formed within the bit body 110. Although one type of cutter 140 used within the drill bit 100 is a PDC cutter; other types of cutters also are contemplated as being used within the drill bit 100. These cutters 140 and portions of the bit body 110 deform the earth formation by scraping and/or shearing depending upon the type of drill bit 100.

FIG. 2A shows a side view of the cutter pocket 160 with a cutter 140 disposed within a cavity 266 formed within the cutter pocket 160, in accordance with the prior art. FIG. 2B shows a profile view of a rear surface 243 of the PDC cutter 140 and a pocket back 262 when the PDC cutter 140 is coupled within the cutter pocket 160, in accordance with the prior art. Referring to FIGS. 2A and 2B, the typical cutter pocket 160 is formed by a machining process, or some other known process, into the blade 130 from the leading edge section 152 of the blade 130. This machining process forms a pocket back 262 and two pocket sides 264, each pocket side 264 being similar to the other, extending outwardly from the pocket back 262 towards the leading edge 152 and are positioned opposite one another. The pocket back 262 and the pocket sides 264 collectively define a cavity 266 for receiving at least a portion of the cutter 140 therein. The pocket back 262 is typically formed with a drill point 263, or cone-shaped indentation, substantially at or near a center of the pocket back 262. This drill point 263 is formed due to a point in the tool (not shown) used during the machining process. The typical cutter pocket 160 provides a "mechanical lock" to the cutter 140 when positioned within the cutter pocket 160 and facilitates coupling of the cutter 140 to the cutter pocket 160 by preventing unwanted movement of the cutter 140 within the cutter pocket 160 during the cutter coupling process, which is known to people having ordinary skill in the art. Typically, this "mechanical lock" has been achieved by forming pocket sides 264 that in combination wrap over more than half of the barrel diameter of the cutter 140. As seen in FIG. 2B, the circumference of the rear surface 243 of the cutter 140 typically overlaps with the circumference of the pocket back 262. Also, each of the pocket sides 264 typically extend circumferentially around a portion of the substrate 142 to be at least greater than seventy percent of the cutter girth 241 as seen when the cutter 140 is positioned within the cutter pocket 160. Typically, the upper edge of the pocket sides 264 is elevationally constant with respect to the circumferential portion of the cutter 140. When coupling the cutter 140 within the cutter pocket 160, the cutter 140 is positioned within the cavity 266 and oriented so that the cutting surface 144 extends outwardly from the leading edge section 152 of the blade 130. Once properly positioned, a bonding material (not shown), such as an adhesive or a braze alloy, is used to fix the cutter 140 within the cutter pocket 160. However, these drill points 263, as mentioned above, formed within the cutter pocket 160 during the machining process inhibit proper flow of the bonding material due to the increase in spacing between the rear surface 243 of the cutter 140 and surface of the drill point 263, and hence, create a weakness in the bond between the cutter 140 and the cutter pocket 160. Further, since the pocket back 262 is typically formed to be one hundred percent of the cutter girth 241 if hardfacing material is added to the top of the pocket back 262/blade top, then this hardfacing material would become a penetration limiter and also a catch point for debris from the wellbore.

BRIEF DESCRIPTION OF THE DRAWINGS

The foregoing and other features and aspects of the invention may be best understood with reference to the following description of certain exemplary embodiments, when read in conjunction with the accompanying drawings, wherein.

Figure 1:
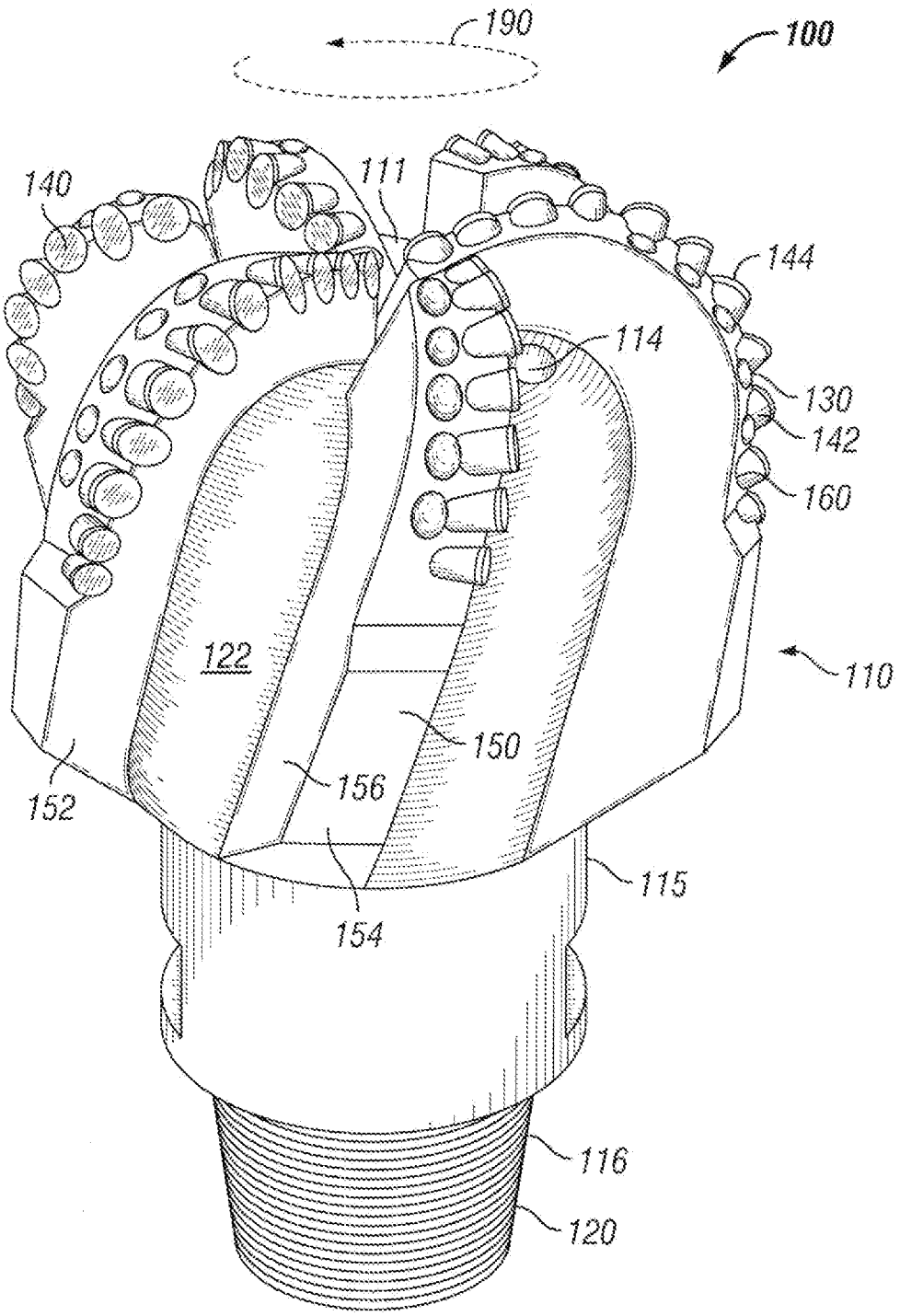
FIG. 1 (Prior Art)
FIG. 1 shows a perspective view of a fixed cutter drill bit in accordance with the prior art.

The drawings illustrate only exemplary embodiments of the invention and are therefore not to be considered limiting of its scope, as the invention may admit to other equally effective embodiments.

DETAILED DESCRIPTION OF INVENTION

The present invention is directed to downhole tools used in subterranean drilling. In particular, the application is directed to cutter pockets formed within downhole tools and methods for fabricating the cutter pockets and mounting a cutter therein. Although the description of exemplary embodiments is provided below in conjunction with a fixed cutter drill bit, similar to that shown in FIG. 1, alternate embodiments of the invention may be applicable to other types of downhole tools having cutter pockets with one or more cutters mounted within a respective cutter pocket, including, but not limited to, steel body PDC drill bits, matrix PDC drill bits, core bits, eccentric bits, bi-center bits, hole openers, underreamers, reamers, and expandable reamers. Although the exemplary embodiments discussed below have been described and/or illustrated with respect to a cylindrically shaped cutter, the cutter can be shaped in any other shape, such as conical-shaped or oval-shaped, unless the exemplary embodiment specifically asserts that a specific cutter shape is used within that particular exemplary embodiment.

The present invention may be better understood by reading the following description of non-limiting, exemplary embodiments with reference to the attached drawings, wherein like parts of each of the figures are identified by like reference characters, and which are briefly described as follows.

Figure 3A:
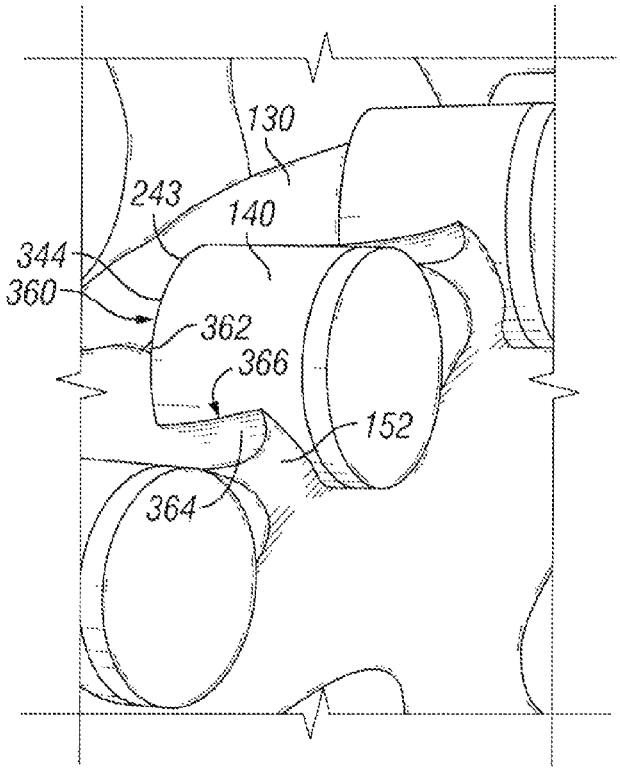
FIG. 3A shows a perspective view of a portion of a blade having a cutter pocket formed therein with a cutter coupled within the cutter pocket, in accordance with an exemplary embodiment of the present invention.
Figure 3B:
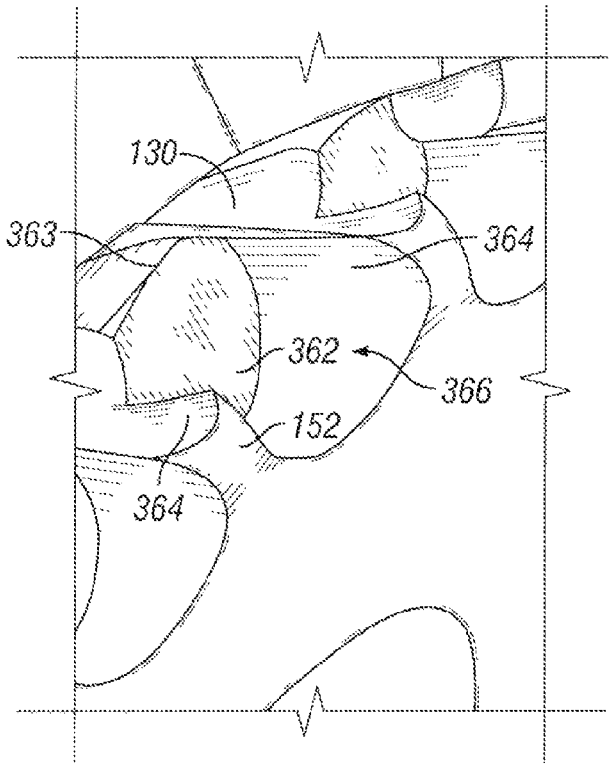
FIG. 3B shows a perspective view of a portion of the blade of FIG. 3A with the cutter being removed from the cutter pocket, in accordance with an exemplary embodiment of the present invention.
Figure 3C:
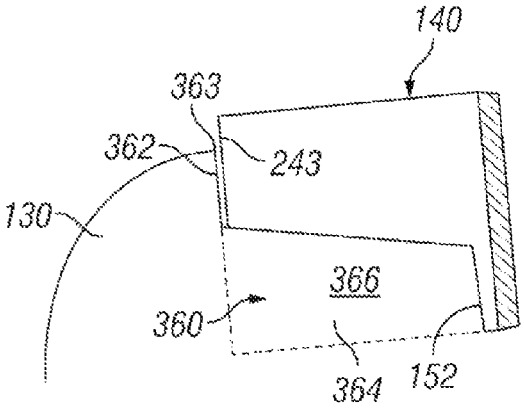
FIG. 3C shows a side view of the cutter pocket of FIG. 3A with the cutter disposed within a cavity formed within the cutter pocket, in accordance with an exemplary embodiment of the present invention.
Figure 3D:
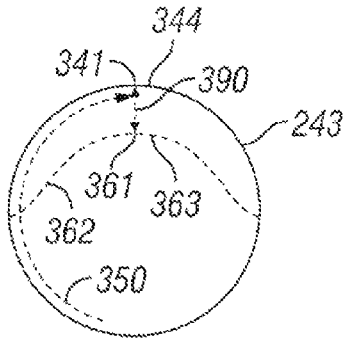
FIG. 3D shows a profile view of a rear surface of the PDC cutter of FIG. 3A and the pocket back of the cutter pocket of FIG. 3A when the PDC cutter is coupled within the cutter pocket, in accordance with the exemplary embodiment.

FIG. 3A shows a perspective view of a portion of a blade 130 having a cutter pocket 360 formed therein with a cutter 140 coupled within the cutter pocket 360, in accordance with an exemplary embodiment of the present invention. FIG. 3B shows a perspective view of a portion of the blade 130 of FIG. 3A with the cutter 140 being removed from the cutter pocket 360, in accordance with an exemplary embodiment of the present invention. FIG. 3C shows a side view of the cutter pocket 360 with the cutter 140 disposed within a cavity 366 formed within the cutter pocket 360, in accordance with an exemplary embodiment of the present invention. FIG. 3D shows a profile view of a rear surface 243 of the PDC cutter 140 and the pocket back 362 of the cutter pocket 360 when the PDC cutter 140 is coupled within the cutter pocket 360, in accordance with the exemplary embodiment. Referring to FIGS. 3A-3D, the cutter pocket 360 is formed within the blade 130 of a drill bit (not shown), which is similar but not identical to the drill bit 100 (FIG. 1). The cutter pocket 360 is similar to cutter pocket 160 (FIG. 1), but is designed differently to accommodate additional features, such as applying hardfacing material thereon, and/or improve the drill bit performance. Further, the cutter 140, in this exemplary embodiment, is cylindrically shaped.

The cutter pocket 360 is formed by a machining or milling process, or some other known process, into the blade 130 from the leading edge section 152 of the blade 130. This machining or milling process forms a pocket back 362 and two pocket sides 364, each pocket side 364 being similar to the other, according to certain exemplary embodiments. However, alternatively, one pocket side 364 is different than the other pocket side in certain exemplary embodiments. Each pocket side 364 extends outwardly from the pocket back 362 towards the leading edge section 152 and is positioned opposite one another. The pocket back 362 and the pocket sides 364 collectively define a cavity 366 for receiving at least a portion of the cutter 140 therein. According to some exemplary embodiments, such as when the drill bit is fabricated using steel, the cutter pocket 360 is machined by a standard cylindrical milling tool (not shown) that cuts quickly and efficiently rather than a surface milling operation. Also, in these exemplary embodiments, an additional milling step is performed to trim down the pocket back 362. According to some exemplary embodiments, such as when the drill bit is fabricated using matrix material, the cutter back 362 is milled into a graphite mold with a smaller form tool, or with a pinpoint tool to achieve the curve differential, as further described below.

Figure 2A:
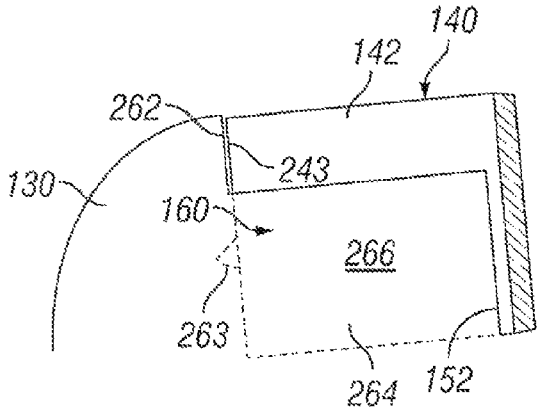
FIG. 2A (Prior Art)
FIG. 2A shows a side view of the cutter pocket of FIG. 1 with a cutter disposed within a cavity formed within the cutter pocket, in accordance with the prior art.
Figure 2B:
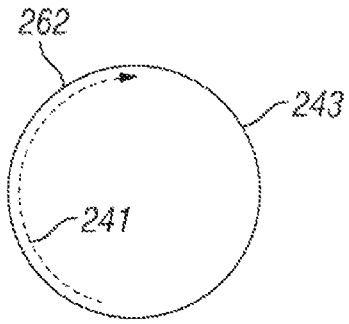
FIG. 2B (Prior Art)
FIG. 2B shows a profile view of a rear surface of the PDC cutter and a pocket back of FIG. 1 when the PDC cutter is coupled within the cutter pocket, in accordance with the prior art.

According to certain exemplary embodiments, the pocket back 362 is initially formed with a drill point (not shown), similar to drill point 263 (FIG. 2A), substantially at or near a center of the pocket back 362 and then subsequently finished to remove the drill point so that the pocket back 362 is substantially smooth or planar. Alternatively, the pocket back 362 is directly formed with a smooth or planar surface according to certain exemplary embodiments. The pocket sides 364 are directly formed with a smooth surface according to certain exemplary embodiments. The smooth surface of the pocket back 362 and/or the inner surface of the pocket sides 364 allow the brazing process to be more effective by having the components to be brazed be separated by a small and uniform, or substantially constant, distance without unnecessary indentations and/or protrusions.

According to certain exemplary embodiments, the upper surface 363 of the pocket back 362 is curve-shaped and is a concentric, near concentric, or filleted concentric form that creates an elevation differential 390 between the apex 361 (top of the curved portion) of the upper surface 363 of the pocket back 362 and the apex 341 (top of the curved portion) of the upper surface 344 of the cutter's rear surface 243. This elevation differential 390 ranges from about 0.010" (ten thousandths of an inch) to about 0.200" (two hundred thousandths of an inch) according to some exemplary embodiments. The upper surface 363 of the pocket back 362 is not planar according to certain exemplary embodiments and does not extend from one end of the pocket side 364 to a corresponding end of the other pocket side 364. Further, the pocket back 362 is not the full circumference of the cutter's rear surface 243; but instead, is smaller than the full circumference of the cutter's rear surface 243. Hence, the pocket back 362 is lower than the cutter's rear surface 243 so that there is sufficient room to apply hardfacing material thereto. In certain exemplary embodiments, the elevation differential 390, or curve differential, is greater than 0.200 (two hundred thousandths of an inch) in certain exemplary embodiments. Hardfacing material, whether applied on matrix or on steel, yields a more erosion resistant and repairable pocket back 362. The pocket sides 364 provide for a "mechanical lock" on the cutter 140 when the cutter 140 is being coupled within the cutter pocket 360. "Mechanical lock" is achieved so that the cutter 140 is gripped within the pocket 360 as the cutter 140 is turned during brazing so that a braze joint with uniform thickness is achieved. This uniform thickness is three thousandths of an inch according to some exemplary embodiments, but ranges from one and one-half thousandths of an inch to about five thousandths of an inch in other exemplary embodiments.

The parent material is the material from which the majority of the bit is fabricated, such as steel or matrix material depending upon the type of bit.

The pocket sides 364 are formed having a progressively reducing elevation extending from the pocket back 362 to the leading edge section 152 of the blade 130 according to some exemplary embodiments. However, in other alternative exemplary embodiments, the pocket sides 364 are formed having a non-progressively reducing elevation extending from the pocket back 362 to the leading edge section 152 of the blade 130. For example, in certain exemplary embodiments, the pocket sides 364 are formed having a progressively increasing elevation, planar elevation, or varying between increasing and decreasing elevations, extending from the pocket back 362 to the leading edge section 152 of the blade 130. The pocket sides 364 also provide for a "mechanical lock" on the cutter 140 when the cutter 140 is being coupled within the cutter pocket 360. According to certain exemplary embodiments, the "mechanical lock' is provided at one end of" the pocket sides 364 that is adjacent the pocket back 362 and substantially where the cutter 140 is brazed to the cutter pocket 360. Alternatively, according to some other exemplary embodiments, the "mechanical lock" is provided at the opposing end of the pocket sides 364 that is distal to the pocket back 362 and/or at some intermediate distance between the one end of the pocket sides 364 that is adjacent the pocket back 362 and the opposing end of the pocket sides 364 that is distal to the pocket back 362. At least the portion of the pocket sides 364 providing the "mechanical lock" includes an arc length that extends between fifty-two percent to sixty-five percent of the cutter's girth 350. However, according to certain exemplary embodiments, the arc length of the portion of the pocket sides 364 providing the "mechanical lock" on the cutter 140 is as low as thirty percent of the cutter's girth 350 when it is to be built back up to at least fifty-two percent of the cutter's girth 350. For example, in certain exemplary embodiments, a hardfacing material is applied, according to known application methods, to at least the upper portion of the pocket sides 364 providing the "mechanical lock" to build back the total arc length of the pocket sides 364 that provide this "mechanical lock" to be equal to or greater than fifty-two percent of the cutter's girth 350, thereby having the pocket side 364 now include the parent material of the bit and the subsequently applied hardfacing material. Hardfacing material, whether applied on matrix or on steel, yields a more erosion resistant and repairable pocket side 364. "Mechanical lock" is achieved so that a braze joint with uniform thickness is achieved. This uniform thickness is three thousandths of an inch according to some exemplary embodiments, but ranges from one and one-half thousandths of an inch to about five thousandths of an inch in other exemplary embodiments. Thus, the arc length of the pocket sides 364 (fabricated from only the parent material) ranges from between thirty percent to sixty-five percent of the cutter's girth 350 according to some exemplary embodiments. In some alternative exemplary embodiments, the arc length of the pocket sides 364 (fabricated from only the parent material) ranges from between thirty percent to sixty percent of the cutter's girth 350. In some alternative exemplary embodiments, the arc length of the pocket sides 364 (fabricated from only the parent material) ranges from between thirty percent to fifty-five percent of the cutter's girth 350. In some alternative exemplary embodiments, the arc length of the pocket sides 364 (fabricated from only the parent material) ranges from between thirty percent to fifty percent of the cutter's girth 350. In some alternative exemplary embodiments, the arc length of the pocket sides 364 (fabricated from only the parent material) ranges from between thirty percent to forty-five percent of the cutter's girth 350.

Figure 4A:
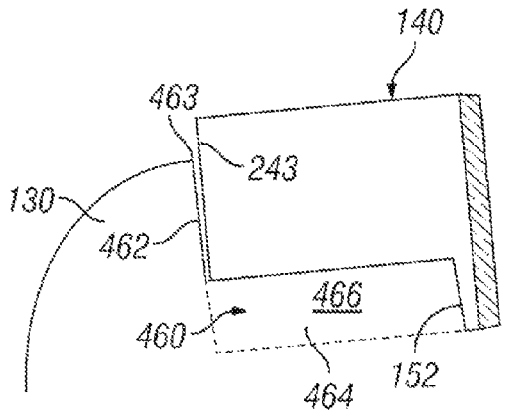
FIG. 4A shows a side view of a cutter pocket with a cutter disposed within a cavity formed within the cutter pocket, in accordance with another exemplary embodiment of the present invention.
Figure 4B:
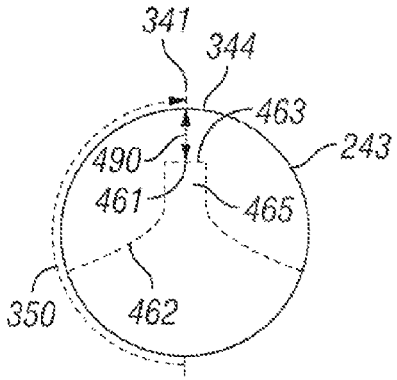
FIG. 4B shows a profile view of a rear surface of the PDC cutter of FIG. 4A and the pocket back of the cutter pocket of FIG. 4A when the PDC cutter is coupled within the cutter pocket, in accordance with another exemplary embodiment.

FIG. 4A shows a side view of a cutter pocket 460 with a cutter 140 disposed within a cavity 466 formed within the cutter pocket 460, in accordance with another exemplary embodiment of the present invention. FIG. 4B shows a profile view of a rear surface 243 of the PDC cutter 140 and the pocket back 462 of the cutter pocket 460 when the PDC cutter 140 is coupled within the cutter pocket 460, in accordance with another exemplary embodiment. Referring to FIGS. 4A and 4B, the cutter pocket 460 is formed within the blade 130 of a drill bit (not shown), which is similar but not identical to the drill bit 100 (FIG. 1). The cutter pocket 460 is similar to cutter pocket 360 (FIGS. 3A-3D), but is designed differently with respect to the shape of the pocket back 462 and the pocket sides 464. Further, the cutter 140, in this exemplary embodiment, has any desired shape, such as cylindrical and conical.

The cutter pocket 460 is formed by a machining or milling process, or some other known process, into the blade 130 from the leading edge section 152 of the blade 130. This machining or milling process forms a pocket back 462 and two pocket sides 464, each pocket side 464 being similar to the other, according to certain exemplary embodiments. However, alternatively, one pocket side 464 is different than the other pocket side in certain exemplary embodiments. Each pocket side 464 extends outwardly from the pocket back 462 towards the leading edge section 152 and is positioned opposite one another. The pocket back 462 and the pocket sides 464 collectively define a cavity 466 for receiving at least a portion of the cutter 140 therein. According to some exemplary embodiments, such as when the drill bit is fabricated using steel, the cutter pocket 460 is machined by a standard cylindrical milling tool (not shown) that cuts quickly and efficiently rather than a surface milling operation. Also, in these exemplary embodiments, an additional milling step is performed to trim down the pocket back 462. According to some exemplary embodiments, such as when the drill bit is fabricated using matrix material, the cutter back 462 is milled into a graphite mold with a smaller form tool, or with a pinpoint tool to achieve the curve differential, as further described below.

According to certain exemplary embodiments, the pocket back 462 is initially formed with a drill point (not shown), similar to drill point 263 (FIG. 2A), substantially at or near a center of the pocket back 462 and then subsequently finished to remove the drill point so that the pocket back 462 is substantially smooth or planar. Alternatively, the pocket back 462 is directly formed with a smooth or planar surface according to certain exemplary embodiments. The smooth surface of the pocket back 462 and/or the inner surface of the pocket sides 464 allow the brazing process to be more effective by having the components to be brazed be separated by a small and uniform, or substantially constant, distance without unnecessary indentations or protrusions.

According to certain exemplary embodiments, the upper surface 463 of the pocket back 462 is partially curve-shaped extending inwardly from the pocket sides 464 and has a pillar 465 extending substantially centrally in an upward direction. Thus, the surrounding side portions of the pillar 465 have been relieved of material. According to certain exemplary embodiments, the upper surface 463 of the pillar 465 is substantially planar; however, this upper surface 463 of the pillar 465 is non-planar in other exemplary embodiments. The upper surface 463 of the pillar 465 creates an elevation differential 490 between an apex 461 (top of the pillar 465) of the upper surface 463 of the pocket back 462 and the apex 341 (top of the curved portion) of the upper surface 344 of the cutter's rear surface 243. This elevation differential 490 ranges from about 0.010" (ten thousandths of an inch) to about 0.015" (fifteen thousandths of an inch) according to some exemplary embodiments. However, in other exemplary embodiments, this elevation differential 490 ranges from about 0.010" (ten thousandths of an inch) to about 0.200" (two hundred thousandths of an inch). The upper surface 463 of the pocket back 462 is not entirely planar according to certain exemplary embodiments and does not extend from one end of the pocket side 464 to a corresponding end of the other pocket side 464. Further, the pocket back 462 is not the full circumference of the cutter's rear surface 243; but instead, is smaller than the full circumference of the cutter's rear surface 243. Hence, the pocket back 462 is lower than the cutter's rear surface 243 so that there is sufficient room to apply hardfacing material thereto. In certain exemplary embodiments, the elevation differential 490 is greater than 0.200" (two hundred thousandths of an inch) in certain exemplary embodiments. For example, in certain exemplary embodiments, a hardfacing material is applied, according to known application methods, to at least the upper surface 463 of the pocket back 462 to build back the total height of the pocket back 462, thereby having the pocket back 462 now include the parent material of the bit and the subsequently applied hardfacing material. Hardfacing material, whether applied on matrix or on steel, yields a more erosion resistant and repairable pocket back 462. The pocket back 462 provides for a "mechanical lock" on the cutter 140 when the cutter 140 is being coupled within the cutter pocket 460. "Mechanical lock" is achieved so that a braze joint with uniform thickness is achieved. This uniform thickness is three thousandths of an inch according to some exemplary embodiments, but ranges from one and one-half thousandths of an inch to about five thousandths of an inch in other exemplary embodiments.

The pocket sides 464 are formed having a substantially planar and constant elevation extending from the pocket back 462 to the leading edge section 152 of the blade 130 according to some exemplary embodiments. However, in other alternative exemplary embodiments, the pocket sides 464 are formed having a non-planar and constant elevation extending from the pocket back 462 to the leading edge section 152 of the blade 130. For example, in certain exemplary embodiments, the pocket sides 464 are formed having a progressively increasing elevation, progressively decreasing elevation, or varying between increasing and decreasing elevations, extending from the pocket back 462 to the leading edge section 152 of the blade 130. In some exemplary embodiments, the pocket sides 464 extend thirty percent of the cutter's girth 350. Alternatively, the pocket sides 464 provide for a "mechanical lock" on the cutter 140 when the cutter 140 is being coupled within the cutter pocket 460 according to certain exemplary embodiments. According to certain exemplary embodiments, the "mechanical lock" is provided at one end of the pocket sides 464 that is adjacent the pocket back 462 and substantially where the cutter 140 is brazed to the cutter pocket 460. Alternatively, according to some other exemplary embodiments, the "mechanical lock" is provided at the opposing end of the pocket sides 464 that is distal to the pocket back 462 and/or at some intermediate distance between the one end of the pocket sides 464 that is adjacent the pocket back 462 and the opposing end of the pocket sides 464 that is distal to the pocket back 462. At least the portion of the pocket sides 464 providing the "mechanical lock" includes an arc length that extends between fifty-two percent to sixty-five percent of the cutter's girth 350. However, according to certain exemplary embodiments, the arc length of the portion of the pocket sides 464 providing the "mechanical lock" on the cutter 140 is as low as thirty percent of the cutter's girth 350 and may be built back up to at least forty-five percent of the cutter's girth 350. For example, in certain exemplary embodiments, a hardfacing material is applied, according to known application methods, to at least the upper portion of the pocket sides 464 providing the "mechanical lock" to build back the total arc length of the pocket sides 464 that provide this "mechanical lock" to be equal to or greater than forty-five percent of the cutter's girth 350, thereby having the pocket side 464 now include the parent material of the bit and the subsequently applied hardfacing material. Hardfacing material, whether applied on matrix or on steel, yields a more erosion resistant and repairable pocket side 464. "Mechanical lock" is achieved so that a braze joint with uniform thickness is achieved. This uniform thickness is three thousandths of an inch according to some exemplary embodiments, but ranges from one and one-half thousandths of an inch to about five thousandths of an inch in other exemplary embodiments. According to some exemplary embodiments, the pocket sides 464 do not provide a "mechanical lock."

Thus, the arc length of the pocket sides 464 (fabricated from only the parent material) ranges from between thirty percent to sixty-five percent of the cutter's girth 350 according to some exemplary embodiments. In some alternative exemplary embodiments, the arc length of the pocket sides 464 (fabricated from only the parent material) ranges from between thirty percent to sixty percent of the cutter's girth 350. In some alternative exemplary embodiments, the arc length of the pocket sides 464 (fabricated from only the parent material) ranges from between thirty percent to fifty-five percent of the cutter's girth 350. In some alternative exemplary embodiments, the arc length of the pocket sides 464 (fabricated from only the parent material) ranges from between thirty percent to fifty percent of the cutter's girth 350. In some alternative exemplary embodiments, the arc length of the pocket sides 464 (fabricated from only the parent material) ranges from between thirty percent to forty-five percent of the cutter's girth 350.

Figure 5A:
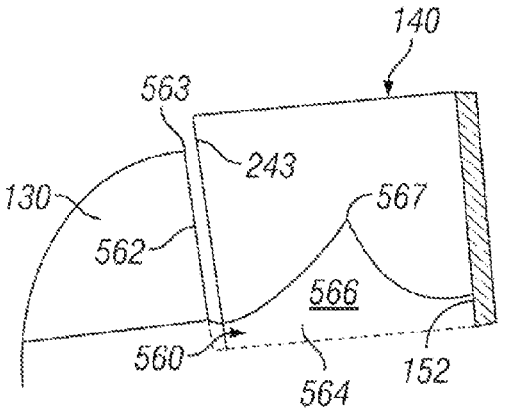
FIG. 5A shows a side view of a cutter pocket with a cutter disposed within a cavity formed within the cutter pocket, in accordance with a third exemplary embodiment of the present invention.
Figure 5B:
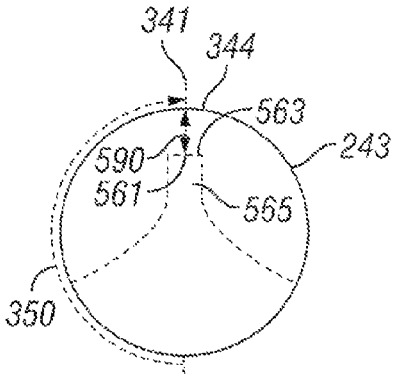
FIG. 5B shows a profile view of a rear surface of the PDC cutter of FIG. 5A and the pocket back of the cutter pocket of FIG. 5A when the PDC cutter is coupled within the cutter pocket, in accordance with the third exemplary embodiment.

FIG. 5A shows a side view of a cutter pocket 560 with a cutter 140 disposed within a cavity 566 formed within the cutter pocket 560, in accordance with a third exemplary embodiment of the present invention. FIG. 5B shows a profile view of a rear surface 243 of the PDC cutter 140 of FIG. 5A and the pocket back 562 of the cutter pocket 560 of FIG. 5A when the PDC cutter 140 is coupled within the cutter pocket 560, in accordance with the third exemplary embodiment. Referring to FIGS. 5A and 5B, the cutter pocket 560 is formed within the blade 130 of a drill bit (not shown), which is similar but not identical to the drill bit 100 (FIG. 1). The cutter pocket 560 is similar to cutter pocket 460 (FIGS. 4A and 4B), but is designed differently with respect to the shape of the pocket sides 564. Further, the cutter 140, in this exemplary embodiment, has any desired shape, such as cylindrical and conical.

The upper surface 563 of the pocket back 562 is formed similarly to the upper surface 463 (FIG. 4A) of pocket back 462 (FIG. 4A). Thus, the surrounding side portions of the pillar 565, similar to pillar 465 (FIG. 4B), have been relieved of material. Hence, the upper surface 563 of the pillar 565 creates an elevation differential 590, similar to elevation differential 490 (FIG. 4B), between an apex 561 (top of the pillar 565) of the upper surface 563 of the pocket back 562 and the apex 341 (top of the curved portion) of the upper surface 344 of the cutter's rear surface 243. This elevation differential 590 ranges from about 0.010" (ten thousandths of an inch) to about 0.015" (fifteen thousandths of an inch) according to some exemplary embodiments; but is different in other exemplary embodiments pursuant to the description provided above with respect to elevation differential 490 (FIG. 4B). Further, in certain exemplary embodiments, at least portions of the pocket back 562 is built up using hardfacing material pursuant to the descriptions provided above with respect to pocket back 462 (FIG. 4B).

The pocket sides 564 are formed having a substantially non-planar and varying elevation extending from the pocket back 562 to the leading edge section 152 of the blade 130 according to some exemplary embodiments. For example, in certain exemplary embodiments, the pocket sides 564 are formed having increasing and decreasing elevations, extending from the pocket back 562 to the leading edge section 152 of the blade 130 such that at least one peak 567 is formed therebetween. This peak 567 forms a point according to certain exemplary embodiments, while in others, this peak 567 is curve-shaped. In some exemplary embodiments, at least portions of the pocket sides 564 extend twenty-five percent of the cutter's girth 350, such as adjacent the pocket back 562 and adjacent the leading edge section 152. The pocket sides 564 also provide for a "mechanical lock" on the cutter 140 when the cutter 140 is being coupled within the cutter pocket 460 according to certain exemplary embodiments. According to certain exemplary embodiments, the "mechanical lock" is provided at some intermediate distance between the one end of the pocket sides 564 that is adjacent the pocket back 562 and the opposing end of the pocket sides 564 that is distal to the pocket back 562. In some exemplary embodiments, the peak 567 provides a "mechanical lock" to the cutter 140. At least the portion of the pocket sides 564, such as the peak 567, providing the "mechanical lock" includes an arc length that extends between fifty percent to ninety-five percent of the cutter's girth 350. For example, the pocket sides 564 extend between a range from fifty percent to ninety-five percent of the cutter girth 350 at a location between the pocket back 562 and the leading edge section 152, while the pocket sides 564 extend less than fifty percent of the cutter girth 350 adjacent the pocket back 562 and adjacent the leading edge section 152. However, according to certain exemplary embodiments, the arc length of the portion of the pocket sides 564 providing the "mechanical lock" on the cutter 140 is as low as thirty percent of the cutter's girth 350 and may be built back up to at least fifty percent of the cutter's girth 350. For example, in certain exemplary embodiments, a hardfacing material is applied, according to known application methods, to at least the upper portion of the pocket sides 564 providing the "mechanical lock" to build back the total arc length of the pocket sides 564 that provide this "mechanical lock" to be equal to or greater than fifty percent of the cutter's girth 350 but less than ninety-five percent of the cutter's girth, thereby having the pocket side 564 now include the parent material of the bit and the subsequently applied hardfacing material. Hardfacing material, whether applied on matrix or on steel, yields a more erosion resistant and repairable pocket side 564. According to some exemplary embodiments, the pocket sides 564 do not provide a "mechanical lock."

Referring to FIGS. 3A-5B, one method for forming the cutter pocket 360 and coupling a cutter 140 within the cutter pocket 360 is provided below. Although the steps have been described according to one order, it is recognized that one or more steps are performed in a different order and/or are combined into fewer steps, and/or are separated into a greater number of steps. In some exemplary embodiments, the cutter pocket 360 is formed into the blade 130 from the leading edge section 152 using a machining process, milling process, or some other known process. The cutter pocket 140 is formed in accordance with any of the exemplary embodiments described above or any obvious variants thereto. For example, the pocket back 362 and/or the inner surface of the pocket sides 364 are made smooth if not already made smooth during cutter pocket 360 formation. However, in other exemplary embodiments, the cutter pockets 360 are formed into the blades 130 during a molding process, such as when fabricating a matrix drill bit. Once the cutter pockets 360 are formed, a hardfacing material is applied onto the surface of the cutter pocket 360. This hardfacing material is able to build up the pocket sides 364 and/or the pocket back 362 depending upon user preferences and upon whether the pocket back 362 and the pocket sides 364 are able to provide the "mechanical lock" to the cutter 140 when placed within the cutter pocket 360. The hardfacing material also makes the cutter pockets 360 more erosion resistant and repairable. The cutter 140 is positioned within the cutter pocket 360 and is brazed to the cutter pocket 360 using methods known to people having ordinary skill in the art.

Although each exemplary embodiment has been described in detailed, it is to be construed that any features and modifications that is applicable to one embodiment is also applicable to the other embodiments.

Although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

I claim:

1. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between fifty-two percent to sixty-five percent of the cutter girth, and an elevation differential is formed between an apex of the upper surface of the first material of the pocket back and an apex of an upper surface of a rear surface of the cutter.

2. The downhole tool of claim 1, wherein the elevation differential ranges from 0.010" (ten thousandths of an inch) to 0.200" (two hundred thousandths of an inch).

3. The downhole tool of claim 1, wherein the upper surface of the pocket back is curve-shaped.

4. The downhole tool of claim 1, wherein the pocket back comprises a pillar extending in a vertically oriented direction.

5. The downhole tool of claim 1, wherein the upper surface of the pocket sides is elevationally constant.

6. The downhole tool of claim 1, wherein the upper surface of the pocket sides is progressively increasing in elevation from the pocket back to the leading edge section.

7. The downhole tool of claim 1, wherein the upper surface of the pocket sides is progressively decreasing in elevation from the pocket back to the leading edge section.

8. The downhole tool of claim 1, wherein the upper surface of the pocket sides is varying between increasing and decreasing elevations.

9. The downhole tool of claim 1, wherein the pocket back is entirely smooth.

10. The downhole tool of claim 1, wherein the maximum arc length is at the pocket back.

11. The downhole tool of claim 1, wherein the maximum arc length is between the pocket back and the leading edge section.

12. The downhole tool of claim 1, wherein the first material is steel.

13. The downhole tool of claim 1, wherein the cutter has a cylindrical shape.

14. The downhole tool of claim 1, wherein the cutter is coupled to the cutter pocket using a brazing material.

15. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between thirty percent to sixty-five percent of the cutter girth, an elevation differential is formed between an apex of the upper surface of the first material of the pocket back and an apex of an upper surface of a rear surface of the cutter, and the upper surface of the pocket back is curve-shaped.

16. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between thirty percent to sixty-five percent of the cutter girth, an elevation differential is formed between an apex of the upper surface of the first material of the pocket back and an apex of an upper surface of a rear surface of the cutter, and the pocket back comprises a pillar extending in a vertically oriented direction.

17. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between thirty percent to sixty-five percent of the cutter girth, an elevation differential is formed between an apex of the upper surface of the first material of the pocket back and an apex of an upper surface of a rear surface of the cutter, and the upper surface of the pocket sides is progressively increasing in elevation from the pocket back to the leading edge section.

18. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between thirty percent to sixty-five percent of the cutter girth, an elevation differential is formed between an apex of the upper surface of the first material of the pocket back and an apex of an upper surface of a rear surface of the cutter, and the upper surface of the pocket sides is progressively decreasing in elevation from the pocket back to the leading edge section.

19. A downhole tool, comprising:

a body;

a plurality of blades extending from one end of the body, the plurality of blades forming a cutting surface, each blade comprising a leading edge section;

one or more cutter pockets formed within each blade, each cutter pocket comprising:

a pocket back fabricated from a first material;

a first pocket side extending from one end of the pocket back to the leading edge section and fabricated from the first material; and a second pocket side extending from an opposing end of the pocket back to the leading edge section and fabricated from the first material, wherein the pocket back and the first and second pocket sides define a cavity;

a cutter positioned at least partially within each cavity and coupled within the cutter pocket, the cutter comprising a cutter girth; and hardfacing material applied to at least an upper surface of the pocket back and to at least an upper surface of the pocket sides, wherein:

a maximum arc length of the first material of the pocket sides ranges between thirty percent to sixty-five percent of the cutter girth, an elevation differential is formed between an apex of the upper surface of the first material of the pocket back and an apex of an upper surface of a rear surface of the cutter, and the upper surface of the pocket sides is varying between increasing and decreasing elevations.

* * * * *